US008113006B2

(12) United States Patent
Rech et al.

(10) Patent No.: US 8,113,006 B2
(45) Date of Patent: Feb. 14, 2012

(54) SYSTEM FOR THE FUEL STORAGE AND FUEL DELIVERY OF CRYOGENIC FUEL

(75) Inventors: Torsten Rech, Munich (DE); Achim Baier, Karlsfeld (DE); Markus Amsz, Fahrenzhausen (DE); Tobias Brunner, Brunnthal (DE); Thomas Hagler, Munich (DE); Oliver Kircher, Germering (DE); Gregor Fischer, Ismaning (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 1098 days.

(21) Appl. No.: 11/753,982

(22) Filed: May 25, 2007

(65) Prior Publication Data

US 2007/0277533 A1 Dec. 6, 2007

(30) Foreign Application Priority Data

Jun. 1, 2006 (DE) ..... 10 2006 025 656

(51) Int. Cl.
*F17C 9/04* (2006.01)
*F17C 7/02* (2006.01)
*F17C 9/02* (2006.01)

(52) U.S. Cl. ..... 62/50.3; 62/50.1; 62/50.2

(58) Field of Classification Search ..... 62/47.1, 62/48.1, 50.1, 50.2, 50.3, 50.7, 53.2
See application file for complete search history.

(56) References Cited

U.S. PATENT DOCUMENTS

RE20,624 E * 1/1938 White ..... 62/48.1
3,866,785 A * 2/1975 Conte ..... 220/560.13
4,009,236 A * 2/1977 Katsuta ..... 264/45.3
4,608,831 A * 9/1986 Gustafson ..... 62/48.1
4,932,214 A * 6/1990 Nieratscher et al. ..... 62/50.6

(Continued)

FOREIGN PATENT DOCUMENTS

DE 24 07 706 A1 9/1975
DE 37 41 145 C2 6/1989
DE 40 41 170 C1 11/1991

(Continued)

OTHER PUBLICATIONS

German Search Report dated May 23, 2007 including English translation of pertinent portion (Nine (9) pages).

*Primary Examiner* — Frantz Jules
*Assistant Examiner* — Lukas Baldridge
(74) *Attorney, Agent, or Firm* — Crowell & Moring LLP

(57) ABSTRACT

A system for cryogenic storage and delivery of fuel, particularly for supplying an internal-combustion engine driving a motor vehicle, includes at least a cryotank having an inner reservoir for receiving the cryogenic medium, which inner reservoir is held in a heat-insulated manner in an outer reservoir, a coolable cooling shield between the inner reservoir and the outer reservoir of the cryotank, and a heat sink. As a thermal-energy storage device, the heat sink is in heat-transmitting contact with the cooling shield. A filling and removal device has at least one pipe penetrating the outer reservoir and leading into the inner reservoir. At least for the filling with or for the removal of cryogenic medium, the heat sink is in heat-transmitting contact with the pipe for the cryogenic medium, in order to reduce the entry of heat from the environment into the inner reservoir while emitting heat. The inner reservoir has a recess in which at least the heat sink and the pipe for the cryogenic medium are housed such that they are situated essentially within the circumferential contour of the inner reservoir.

33 Claims, 1 Drawing Sheet

U.S. PATENT DOCUMENTS

| | | | | | |
|---|---|---|---|---|---|
| 5,218,827 | A | * | 6/1993 | Pevzner | 62/50.6 |
| 5,265,430 | A | * | 11/1993 | Chen et al. | 62/48.1 |
| 5,477,690 | A | * | 12/1995 | Gram | 62/45.1 |
| 5,682,750 | A | * | 11/1997 | Preston et al. | 62/50.2 |
| 5,685,159 | A | * | 11/1997 | Kooy et al. | 62/50.1 |
| 5,787,940 | A | * | 8/1998 | Bonn et al. | 141/18 |
| 2003/0221433 | A1 | * | 12/2003 | Gustafson | 62/48.1 |
| 2005/0028536 | A1 | * | 2/2005 | Noble et al. | 62/45.1 |
| 2005/0056027 | A1 | * | 3/2005 | White | 62/50.5 |
| 2005/0086949 | A1 | * | 4/2005 | Noble et al. | 62/50.1 |

FOREIGN PATENT DOCUMENTS

| | | | | |
|---|---|---|---|---|
| DE | 100 01 207 | A1 | | 7/2001 |
| DE | 10005726 | A1 | * | 8/2001 |
| DE | 103 21 213 | A1 | | 12/2003 |
| DE | 10 2004 011 653 | A1 | | 9/2005 |
| DE | 10 2004 039 840 | A1 | | 2/2006 |
| EP | 0 411 505 | B1 | | 2/1991 |
| EP | 0 779 468 | B1 | | 6/1997 |
| WO | WO 01/94839 | A1 | | 12/2001 |

* cited by examiner

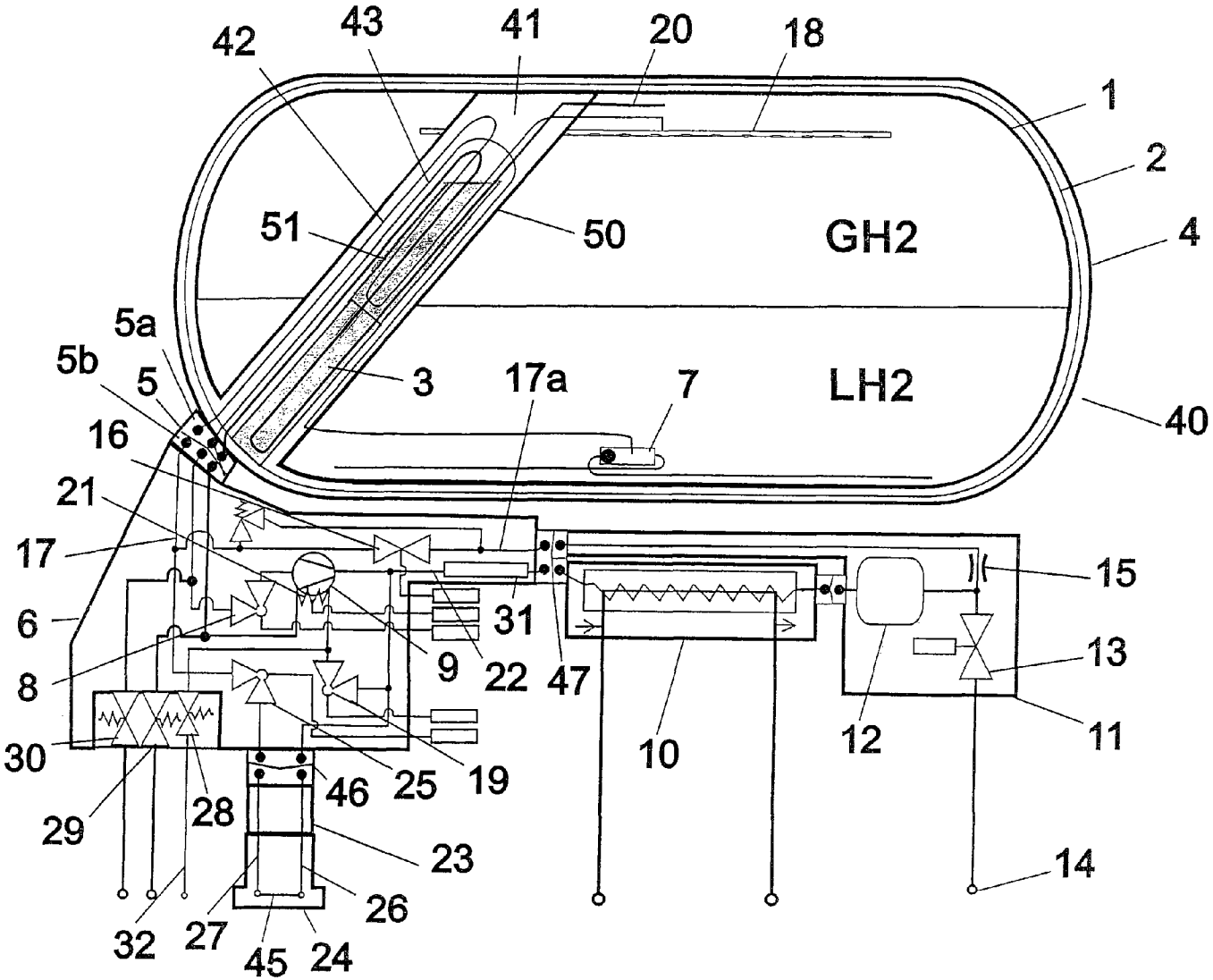
GH2
LH2
1
2
4
40
15
13
11
14
12
18
20
7
10
50
47
41
17a
31
22
19
9
23
3
25
26
43
46
24
51
45
42
28
27
5a
5
32
5b
16
21
29
17
6
8
30

SYSTEM FOR THE FUEL STORAGE AND FUEL DELIVERY OF CRYOGENIC FUEL

BACKGROUND AND SUMMARY OF THE INVENTION

This application claims the priority of German Application No. 10 2006 025 656.5, filed Jun. 1, 2006, the disclosure of which is expressly incorporated by reference herein.

The invention relates to a system for the cryogenic storage and delivery of fuel, particularly for supplying an internal-combustion engine driving a motor vehicle. Concerning the technical background, in addition to German Patent document DE 37 41 145 C2, reference is made to German Patent document DE 40 41 170 C1.

Fuels for driving motor vehicles, such as hydrogen, natural gas, or the like, can practically only be stored in a liquefied and therefore highly cooled state in order to reach the required volumetric and gravimetric storage densities. However, in the case of this cryogenic fuel storage, a small quantity of liquid fuel evaporates continuously as a result of the entry of heat into the fuel tank. The pressure in the fuel tank thereby increases until the limit value set for the latter—also called boil-off pressure—has been reached and the further evaporating fuel has to be blown off from the fuel tank as so-called boil-off gas. Particularly when no consuming device for the fuel is in operation, that is, particularly when the internal-combustion engine is inoperative, without any removal, the internal tank pressure will rise, as a result of the entry of heat. For reasons of safety, this pressure has to be limited by the opening of valves. In general, the boil-off gas in this case is emitted into the environment by way of blow-off pipes, in which the above-mentioned valves are provided. In addition to the extent of the heat entry, the selection of the operating pressure in the fuel tank and of the pressure deviation between the operating pressure and the boil-off pressure decisively determine the lossless pressure buildup time.

The cryogenic liquid hydrogen supply is stored in the vehicle in a boiling or almost boiling state in the thermally very well insulated pressure-tight reservoir. In this case, the physical density of the boiling hydrogen becomes maximal by the storage at a temperature slightly above the boiling temperature at ambient pressure, i.e., approximately 20 K. In today's technically implemented storage reservoirs, the hydrogen is typically present at temperatures of approximately 21 K to approximately 27 K, and the corresponding boiling pressures of approximately 2 bar (abs) to approximately 5 bar (abs). In the lower part of the storage reservoir, the boiling hydrogen is present as a denser-mass liquid phase (LH2) and, situated above the lower part, as a gaseous phase (GH2). A gaseous as well as a liquid removal of the hydrogen from the storage reservoir is possible and meaningful. By the removal of hydrogen during the operation of the storage device when supplying the internal-combustion engine after a pressure buildup phase, the storage pressure is reduced until the storage device operating pressure has been reached without any targeted heat entry. Because of the lower carrying away of enthalpy during the liquid removal and the resulting slower pressure reduction, a removal from the gaseous phase (gas removal) is meaningful for this purpose.

The direct delivery of the hydrogen from the storage reservoir into a flow pipe to a conditioning or consuming device therefore, in the simplest case, takes place by way of the static pressure difference existing between the tank interior and the environment or by an exercising of pressure upon the storage reservoir. Here, it is basically possible to give LH2 priority during the conveyance or to convey only GH2 as a result of the geometric design of the flow pipe starting in the tank interior. The providing of hydrogen with respect to mass and pressure therefore takes place as a result of the inherent pressure of the hydrogen in the tank reservoir and the hydrogen is fed to the drive assembly by opening various valves with removal/volume-flow-dependent pressure losses. A temperature conditioning takes place in a heat exchanger outside the insulated storage reservoir. A pressure collapse in the tank reservoir resulting from the removal of hydrogen during the operation of the fuel supply system is prevented by the targeted heat entry either by way of a return of a partial flow of the removed heated hydrogen into a closed interior tank heat exchanger loop leading into the tank reservoir (and a heat exchange taking place there with a subsequent reconditioning and providing it to the drive assembly), or by way of a heating cycle (for example, an electric heater) which is independent of the removal.

Furthermore, it is known that, for increasing the pressure buildup time and for reducing the evaporation rate, the thermally active mass within the insulated tank structure can be increased along the heat inflow and heat outflow paths. This measure may also be combined, for example, with a device for cooling situated in the insulated area, corresponding to German Patent document 40 41 170 C1, which also has the purpose of storing the enthalpy required for heating the flowing-off GH2 to maximally the ambient temperature level and to consume it as a local heat sink for the quantities of heat penetrating into the tank. For prolonging the lossless pressure buildup time, a heat sink can therefore be used which, during the removal operation, is cooled by the cold-removed hydrogen coupled by way of the existing removal pipe and, particularly in the operating pauses, during the pressure buildup time, absorbs heat from the coupled heat shield.

In addition, from the initially mentioned German Patent document DE 40 41 170 C1, a system is known for reducing the boil-off gases by use of a cooled radiation shield, which delays the heat incidence into the reservoir with the cryogenically stored fuel. In order to keep the entire heat incidence into the reservoir as low as possible, all valves required for the fueling and the engine supply are housed outside the tank in a separate control unit. This valve combination, which is vacuum-insulated separately, contains the connections for the fueling and is connected with the vehicle tank or with the fuel pipe leading to the engine by way of vacuum-insulated pipes. In addition, German Patent document DE 37 41 145 C2 describes a removal system for liquid hydrogen, having a delivery unit which is situated outside a storage tank and whose feed pump has a cooling storage jacket which is formed by hydrogen exiting from the feed pump on the delivery side.

The components, through which the liquid or gaseous hydrogen of approximately 23 K flows during the operation, have to be well insulated in order to keep the heat entry and thus the evaporation of the liquid hydrogen as low as possible. Furthermore, the liquefaction of air on the cold surfaces of the components is to be avoided. In addition to a separate control unit, the housing of these components in the reservoir vacuum between the inner reservoir and the outer reservoir is also known from various publications.

As a result of the housing of these components in the reservoir vacuum between the inner reservoir and the outer reservoir, the radiation insulation also situated there and the cooling shield are disturbed and their insulation effect is reduced. In addition, the mounting of the insulation thereby becomes more difficult and therefore requires high expenditures and costs. By placing the components out of the vacuum space of the reservoir into a separate control unit with an additional vacuum space, the insulation of the cryoreservoir will no longer be disturbed, and is therefore improved in its insulation effect. The components in the additional vacuum space can therefore be serviced without breaking the vacuum and thereby causing an expensive new evacuation of the cryoreservoir. As a result of the displacement of the components, potential leakage points, which may result in a vacuum loss, are situated outside the reservoir vacuum.

European Patent document EP 411 505 B2 describes a method and a device for storing cryogenic liquids, wherein a heat sink in the heat exchange with a heat shield is provided, and the heat sink is situated between the outer vessel and the inner vessel. Such a cryotank cannot be manufactured in a simple and low-cost fashion and has no optimal insulation because the arrangement of the heat sink in the vacuum space between the outer vessel and the inner vessel disturbs the multilayer insulation accommodated there, and thus impairs its insulation effect.

Furthermore, this arrangement prevents an automated mounting of the multilayer insulation. The considerable mounting expenditures for the multilayer insulation result in considerable mounting costs.

It is an object of the present invention to provide a remedial measure for the described problems.

This, and other objects are achieved according to the invention, in which a system for the cryogenic storage and delivery of fuel, for supplying a consuming device, particularly an internal-combustion engine driving a motor vehicle, comprises at least a cryotank consisting at least of an inner reservoir for receiving the cryogenic medium, which is held in a heat-insulated manner in an outer reservoir, a coolable cooling shield between the inner reservoir and the outer reservoir of the cryotank, a heat sink which, as the thermal-energy storage device, is in a heat-transmitting contact with the cooling shield, and a filling and removal device having a pipe penetrating the outer reservoir and leading into the inner reservoir, at least for the filling with or for the removal of cryogenic medium, the heat sink being in a heat-transmitting contact with the pipe for the cryogenic medium, in order to, while emitting heat, reduce the heat entry from the environment into the inner reservoir. The invention is characterized in that the inner reservoir has a recess in which at least the heat sink and the pipe for the cryogenic medium are accommodated such that they are situated essentially within the circumferential contour of the inner reservoir.

By way of the arrangement of the pipe for the cryogenic medium and the heat sink in the recess, partly also called a pipe conduit module, the multilayer insulation can easily be mounted manually or in an automated manner in the vacuum space between the inner reservoir and the outer reservoir. As a result, the mounting expenses are advantageously reduced. Undisturbed, the multilayer insulation surrounds the entire inner reservoir, causing a good insulation.

A preferred embodiment of the invention is characterized in that the heat sink is in a heat-transmitting contact exclusively with a pipe for the removal of gaseous cryogenic medium. This has the advantage that the cooling shield can be actively cooled by way of the heat sink, which, in turn, during the operating pauses, in the lossless pressure buildup time, minimizes the heat entry into the inner reservoir from the environment. The reason is that, as a result of the sole coupling of the pipe for the removal of gaseous cryogenic medium, thus, of the gas removal and boil-off pipe, to the heat sink, its cooling is ensured during the gas removal, during the boil-off and during the fueling (by return gas). In addition, this is used for prolonging the lossless pressure buildup time and for prolonging service life connected therewith and with the size of the boil-off mass flow until the storage device is almost completely evacuated, by means of cooling the cooling shield. This can also take place directly by coupling the gas removal pipe to the cooling shield or, as described above, via a buffer in the form of a heat sink.

Another preferred embodiment of the invention is characterized in that the heat sink has one or more continuous cavities, particularly through-holes, to whose inlet and outlet the pipe for removing gaseous cryogenic medium is sealingly connected.

If the heat sink is integrated in the pipe for the removal of cryogenic medium in this manner, this has the advantage that the removed cryogenic medium will flow directly through the metallic heat sink. The resistance to the heat transfer through the pipe wall of the removal pipe is thereby eliminated, and the heat transfer from the metallic heat sink to the cryogenic medium is improved. This leads to a faster cooling of the heat sink and of the linked cooling shields.

In a further preferred embodiment of the invention, the, in particular, pocket-hole-type recess in the inner reservoir is a blending of the inner reservoir with a cylinder.

Such an inner reservoir construction with an integrated, so-called pipe conduit module, in which, in addition to the addressed removal pipe, also additional necessary pipes and the heat sink are arranged, has the advantage that it can be manufactured in a simple manner. Furthermore, it is advantageous for the insulation effect as well as for a simple construction of the cryotank that all pipes leading into the inner reservoir extend through its blending surface with the recess.

If then the heat sink projects with its one end so far beyond the circumferential contour of the inner reservoir that it forms a heat-transmitting connection with the cooling shield, this further embodiment promotes a simple cryotank construction even more. For this purpose, the heat sink may be connected in an easily heat-transmitting fashion with its one end in a simple manner by way of screws and/or rivets with the cooling shield which is situated within the multilayer insulation between the inner reservoir and the outer reservoir.

An advantageous embodiment of the invention is characterized in that another cooling shield surrounds pipes within the recess and is connected with the heat sink. As a result, the feeding of heat of these lines onto the inner tank is reduced. By means of this arrangement, the insulation of the inner reservoir is less disturbed by the heat sink and the insulation effect is not negatively affected.

A preferred embodiment of the invention provides that, for evacuating and filling the cryotank, at least three pipes are provided which extend from the inner reservoir through the recess in the inner reservoir, out of the outer reservoir into an accessory container, the first pipe being provided for the removal of cryogenic medium predominantly in liquid form from the lower area of the cryotank, the second pipe being provided for the removal of cryogenic medium predominantly in gaseous form from the upper area of the cryotank, and the third pipe being provided for the return of the medium as warm gas into the upper area of the cryotank. The accessory container which, in particular, is vacuum-insulated and/or evacuated, contains cold accessories for filling and evacuating the cryotank. In this case, the container wall of the accessory container, particularly its interior side, may be equipped with a heat insulation layer.

Thus, a construction of the system for the cryogenic storage and delivery of fuel for supplying a consuming device is created which is very advantageous with respect to maintenance.

If, in this further advantageous embodiment, the accessory container is vacuum-insulated and/or evacuated and/or its container wall, particularly on its interior side, is provided with a heat insulation layer, conveying elements and accessories in the accessory container can advantageously be kept cold for a long time and particularly easily.

In another advantageous embodiment of the invention, the accessory container is connected with the cryotank by means of at least one coupling device which, in particular, is separable, the coupling device establishing tight connections between pipes leading out of the cryotank and out of the accessory container.

This has the advantage that the connection device between the cryotank and the accessory container can be produced in a reliable, simple and low-cost manner, and a liquid conveying of the cryogenic medium in the accessory container can take place because of the proximity of the cryotank, because the cryogenic medium removed in a liquid state was only slightly heated beforehand.

Another advantageous embodiment of the invention provides that the coupling device consists of a cryotank-side coupling part and an instrument-container-side coupling part, the cryotank-side coupling part being mounted on the outer reservoir. In this advantageously simple manner, the accessory container is securely fixed on the outer reservoir by way of the coupling device.

A preferred embodiment of the invention provides that the accessory container has at least one additional connection point, particularly for filling the cryotank and/or for supplying the consuming device, which connection point, by way of at least one, in particular, releasable coupling device with at least one connection part, particularly with a fueling coupling and/or with a heat exchanger and/or with a secondary system capsule, establishes tight connections between pipes leading out of the accessory container and the connection part.

Additional preferred embodiments of the invention provide that a delivery device, at least for removing liquid cryogenic medium from the cryotank, is housed in the armature container, which delivery device can also be cooled by means of another heat exchanger.

As a result of the use of such a cold delivery device in the accessory container with a removal of liquid, it becomes possible to provide pressures of up to approximately 20 bar to an internal-combustion engine while the pressure in the hydrogen storage reservoir is simultaneously low. This permits an efficient supplying of the internal-combustion engine as required (for example, in the full-load operation) and simultaneously a hydrogen mass in the storage device increased by the lower storage pressure (when the filling end pressure is lower) as well as a lossless pressure buildup time increased as a result of the rising pressure deviation between the storage pressure and the boil-off pressure. It is advantageous for the delivery device to be a feed pump which has a lower heat capacity.

Because of the non-coupling to the heat sink, the first pipe—the liquid removal pipe—is subjected to no heat entry from the heat sink and the coupled cooling shield that would interfere with the optimal operation of the feed pump. The combined usable filling and return gas pipe for maintaining the pressure—the third pipe—is also not coupled to the heat sink. This ensures a faster filling as a result of reduced heat entries into the filling pipe during the filling and prevents a disturbing heating of the heat sink during the warm-gas return for maintaining pressure.

An embodiment of the invention which is also advantageous for the pressure increase is characterized in that the heat exchanger is connected between the accessory container and the consuming device.

If then a pressure reservoir for gaseous cryogenic medium is provided which is connected such, particularly in the direction of the consuming device, behind the heat exchanger, between the accessory container and the consuming device that the consuming device as well as the cryotank can be supplied from the pressure reservoir with pressurized gaseous cryogenic medium, this has the advantage that a damping of pressure fluctuations takes place as a result of the use of the feed pump and the change between the operating modes of the gas removal and the liquid removal with a providing of pressure by the feed pump. In addition, the pressure reservoir together with the additional buffer area in the outlet of the cold pipe of the accessory container can be used for storing a residual quantity of hydrogen, by means of which a starting of the internal-combustion engine can be ensured in the absence of the availability of a hydrogen conditioning (for example, lack of heat during a cold start).

That the cryotank can be supplied with pressurized gaseous cryogenic medium also has the advantage that, by generating targeted imbalance conditions in the inner reservoir, pressure effects on the liquid phase and thus a supercooling of the hydrogen around the liquid removal device are promoted. This improves the liquid charging of the feed pump. The effects of an exercising of pressure can also be utilized particularly during the cold operation of parts of the fuel supply system in operating pauses before the start of the operation. In this respect, an embodiment of the invention is very advantageous in which the pipe for exercising pressure on the liquid cryogenic medium—thus, the third pipe—, is equipped with a diffuser at the pipe end in the cryotank.

Only the use of a feed pump for returning hot gas during the pressure maintenance phases permits the operation of a diffuser instead of a closed inner tank heat exchanger loop. This saves a return pipe and thus a heat entry during operating pauses, which results in longer pressure buildup times. Simultaneously, the invention now only still has one central access from below into the inner reservoir, which avoids additional thermal bridges, reduces thermal layering (thermal layering in the inner reservoir only in the case of heat bridges from above) and requires only one releasable central coupling.

In another embodiment of the invention, the second pipe is connected to the additional heat exchanger in order to cool the delivery device.

The availability of the full delivery capacity of the delivery device depends on a sufficiently high fraction of the liquid hydrogen phase when entering into the delivery device and avoidance of evaporation as a result of the inherent heat of the delivery device. In this case, the cooling of the delivery device in its operating pauses during the gas removal or in the boil-off is ensured by coupling the gas removal pipe to the delivery device by way of another heat exchanger.

Advantageous embodiments of the invention are characterized in that the first and the second pipe in the direction of the consuming device are joined behind the delivery device or behind the additional heat exchanger, and that a connection pipe exists between the filling pipe and a return gas pipe, which connection pipe connects the filling pipe with the return gas pipe when the fueling coupling is not used for fueling.

The use of the thus connected cold feed pump permits the cold operation of the filling train, including the filling pipe and the filling coupling by the return of cryogenic medium into the inner reservoir and thereby without the necessity of using or removing the cryogenic medium required for the cold operation. The described cold operation shortens the filling time and can reduce the return gas losses occurring during the filling. The described cold operation process can advantageously also be used for operating the feed pump itself cold.

According to a further embodiment of the invention, the first pipe and/or the second pipe or the junction of the first and second pipe, in the direction of the consuming device, behind the delivery device or behind the additional heat exchanger is in a heat transmitting contact with the heat exchanger. Furthermore, the third pipe for filling the cryotank is connected with the fueling coupling by way of a filling pipe.

By way of such an advantageous interconnection of the pipes, the diffuser can be utilized for the filling and for maintaining the pressure as a result of the hot gas return. During the fueling, the diffuser is used for the targeted distribution of the filled-in liquid hydrogen, and in the liquid removal operation, heated hydrogen gas returned for maintaining pressure in the cryotank is distributed in the gas chamber in order to thereby ensure a supplying of the feed pump with supercooled liquid hydrogen.

A further advantageous embodiment of the invention is characterized in that the second pipe, in the direction of the consuming device, behind the additional heat exchanger and in front of a junction with the first pipe, has a branch pipe into the fueling coupling which, during a fueling, as a return gas pipe, leads gaseous cryogenic medium displaced from the cryotank as a result of its filling to the fueling coupling.

By using the second pipe—the gas removal pipe—as the return gas pipe during the filling operation, because of its thermal coupling by way of the additional heat exchanger to the delivery device, an improved availability of the full delivery capacity is ensured after a fueling operation.

Additional advantageous embodiments of the invention are characterized in that a branch pipe to a pressure relief valve is connected to the second pipe in the consuming device direction behind the additional heat exchanger, which pressure relief valve, when a limit pressure—the boil-off pressure—has been reached, opens up for blowing off gaseous medium from the cryotank. In addition, a branch-off pipe to a first excess pressure safety valve is connected to the second pipe, particularly in the consuming device direction, in front of the additional heat exchanger, which excess pressure safety valve opens when a limit pressure above the boil-off pressure is reached, for blowing off gaseous medium from the cryotank. In addition, a branch off pipe to a second excess pressure safety valve may be connected to the first pipe, particularly in the direction of the consuming device, in front of the delivery device, which excess pressure safety valve opens when a limit pressure above the boil-off pressure is reached for blowing off cryogenic medium GH2, LH2 from the cryotank.

As a result of the availability of safety valves at the gas removal pipe and at the liquid removal device, advantageously, the secure removal of sufficient amounts of hydrogen is improved in the case of a fault event/safety event (for example, high degradation of the insulation) also in overhead positions, without having to enlarge the pipe cross-sections of the pipes leading into the inner reservoir. This leads to a reduction of the heat entry during operating pauses, and thus to an increased lossless pressure buildup time.

In further advantageous embodiments of the invention, the liquid removal pipe is linked to a change-over device which, until the cryotank is largely evacuated, causes a removal of liquid hydrogen LH2. Such devices known per se from the state of the art provide that, when the cryotank is in an inclined position, the removal takes place where the liquid medium is situated.

Furthermore, the accessory container is advantageously placed such that the delivery device is situated below or at the same level as pipe openings for the liquid removal in the lower area of the cryotank. This promotes the liquid charging and saves a pressure-buildup container or avoids cavitation.

Other objects, advantages and novel features of the present invention will become apparent from the following detailed description of the invention when considered in conjunction with the accompanying drawings.

BRIEF DESCRIPTION OF THE DRAWING

The single FIGURE is a schematic longitudinal sectional view of a reservoir according to the invention for the storage of a cryogenic medium having a removal and filling device according to the invention.

DETAILED DESCRIPTION OF THE DRAWING

The entire fuel supply system for cryogenic hydrogen (and similar fluids) consists of an insulated storage reservoir having a cooling shield and a heat sink, including a gas removal pipe linked to the heat sink as well as a device for the removal of liquid and a combined fueling and hot-return gas pipe constructed as a diffuser for maintaining pressure in the removal operation, having a secondary vacuum module, including shut-off valves and a coolable cryogenic feed pump for providing pressure, having a heat exchanger module for equalizing the temperature of the removed pressure-conditioned hydrogen, having a secondary system module, including buffer reservoirs against pressure peaks, having safety pipes on the liquid and gas removal pipe and having a filling pipe which can be cooled before the filling operation, together with the filling coupling.

A cryotank 40 for storing liquid hydrogen LH2 is installed in a motor vehicle (not shown). This liquid hydrogen LH2 is used as fuel for supplying an internal-combustion engine (also not shown), drives the motor vehicle and is coupled to a transmission assembly inlet 14. The cryotank 40 is a reservoir consisting of a pressure-resistant inner reservoir 1 disposed by way of a bearing device, which is not shown, in an outer reservoir 4, with an insulation layer disposed in-between and a cooling shield 2 embedded in this insulation layer. A heat sink 3, as a heat storage device, is connected in a thermally conductive manner with the shield 2, which heat sink 3 is used as a buffer storage device for the heat entering from the environment through the insulation. The heat sink 3 is situated in the primary insulation zone, in a recess 41 of the inner reservoir 1, into which all accesses to the inner reservoir 1 also lead, which extend from there by way of a releasable central coupling 5 mounted on the outer reservoir 4 out of the latter. By way of the central coupling 5, a vacuum-insulated accessory container 6, which contains cold accessories for filling and evacuating the cryotank 40, is coupled as a secondary insulated cold module to the outer reservoir 4, and the accesses to the inner reservoir 1 extend by way of the central coupling 5 out of the outer reservoir 4 into the accessory container 6. The coupling device 5 establishes tight connections between the cryotank 40 and pipes 20, 42, 43 extending out of the accessory container 6.

The coupling device 5 consists of a cryotank-side coupling part 5*a* and an instrument-container-side coupling part 5*b*, the cryotank-side coupling part 5*a* being mounted on the outer reservoir 4.

The accessory container 6 has two additional connection sites, specifically one for filling the cryotank 40 and one for supplying the consuming device. These connection sites, by way of, in each case, a further particularly a releasable coupling device 46, 47 with one connection part, one fueling coupling 24 and one heat exchanger 10 or one secondary system capsule 11 respectively, establish tight connections between pipes 22, 26, 27 leading out of the accessory container 6 and the connection part.

In this case, the accessory container 6 is placed such that a feed pump 9 is situated below or at the same level as pipe openings for the liquid removal in the lower area of the cryotank 40.

For filling and evaluating the cryotank 40, a filling and removal device is provided, which has three accesses to the inner reservoir 1. These three pipes extend from the inner reservoir 1 through its recess 41, which is situated essentially within the circumferential contour of the inner reservoir 1 and in which the heat sink 3 is also housed, out of the outer reservoir 4, and into the accessory container 6. A pipe 43 is used for the removal of cryogenic medium predominantly in the liquid state out of the lower area of the cryotank 40. A second pipe 20 is used for the removal of cryogenic medium predominantly in the gaseous state from the upper area of the cryotank 40, and a third pipe 42, whose pipe end in the cryotank 40 is equipped with a diffuser 18, is used for returning the medium as hot gas into the upper area of the cryotank 40 and, during the filling of the cryotank 40, as a filling pipe.

All pipes 20, 42, 43 leading into the inner reservoir 1 extend through its blending surface 50 with the cylindrical recess 41. For the connection of the cooling shield 2 with the heat sink 3, the latter projects with its one end beyond the circumferential contour of the inner reservoir 1 to such an extent that, connected with the cooling shield 2 via screws, which are not shown, it forms a heat-transmitting connection. By way of an additional smaller cooling shield 51, which partially surrounds the second and the third pipe 20, 42 within the recess 41 and is connected with the heat sink 3, the entry of heat from these pipes 20, 42 into the inner reservoir 1 is reduced. This arrangement does not interfere with the insulation of the inner reservoir 1 by the heat sink 3 and the insulation effect is not negatively influenced.

By way of a liquid removal change-over device 7, in the case of a full-load demand by the internal-combustion engine or in the partial load operation, when the pressure falls below the lowest supply pressure in the cryotank 40 required for the internal-combustion engine, cryogenically stored hydrogen in the liquid phase LH2 is removed from the cryotank 40 by way of the first pipe 43 and is guided past the heat sink 3 by way of a cold valve 8 disposed in the accessory container 6, to the cold feed pump 9 for predominantly liquid hydrogen. This feed pump 9 compresses the liquid hydrogen LH2 to the pressure level provided for the internal-combustion engine during the full-load or partial load operation. By way of a main removal pipe 22 through a buffer volume 31, the compressed hydrogen is guided into a second heat exchanger 10, its temperature is equalized there, and the hydrogen is guided by way of a pressure accumulating reservoir 12, which is disposed in a secondary system capsule 11 and is used for the damping of pressure fluctuations, and a shut-off valve 13 to the drive assembly inlet 14.

When the pressure unacceptably falls below a minimum pressure in the inner reservoir 1, by way of opening a control valve 16, a quantity of the heated removal mass flow controlled by way of a throttle 15 is introduced into a filling pipe 17 and is guided there by way of the central coupling 5 through a third pipe 42 past the heat sink 3 into the diffuser situated in the inner reservoir 1 and used for filling and maintaining the pressure. The diffuser 18 distributes the hot gaseous hydrogen GH2 in the inner reservoir 1 and thus supplies heat to the cryotank 40, which is required for maintaining the pressure. The arrangement of the diffuser 18 in the upper area of the inner reservoir 1 which, for the most part, is taken up by the gaseous phase of the stored hydrogen GH2, is used for a targeted establishment of an imbalance in the stored hydrogen and therefore ideally, as a result of the rise in pressure, leads to a supercooling of the liquid hydrogen LH2 in the area of the liquid removal device. The resulting supercooling can contribute to the fact that the hydrogen fed to the cold feed pump 9, despite the absorption of heat in the feed pipes to the feed pump 9, reaches the feed pump 9 in a largely liquid state and thus contributes to an efficient operation of the feed pump 9. Furthermore, the thus established imbalance in the stored hydrogen at the beginning of operating pauses contributes to a pressure drop by the delayed-start slow approaching of the saturation condition (mixing) and the occurring equilibrium and thus ideally increases the pressure deviation and thus the lossless pressure buildup time in the cryotank 40 until a limit pressure—the boil-off pressure—is reached, at which the gaseous medium GH2 is to be blown off from the cryotank 40.

In the partial-load operation of the internal-combustion engine, at pressures in the inner reservoir 1 above the lowest supply pressure for the partial-load operation, a hydrogen removal in the gaseous phase GH2 is provided in order to, because of the enthalpy removal from the inner reservoir 1 which is higher during the gas removal, be able to reduce the pressure in the inner reservoir 1 to the minimum pressure. For this purpose, by opening a cold valve 19 situated in the accessory container 6, gaseous hydrogen GH2, driven by the pressure in the inner reservoir 1 is removed by way of the second pipe 20 for the removal of gas projecting into the inner reservoir 1, from the inner reservoir 1, is guided through the heat sink 3, which is in a heat-transmitting contact exclusively with the second pipe 20 for the removal of gaseous cryogenic medium, and the central coupling 5, into the accessory container 6. By way of a first heat exchanger 21, the gaseous hydrogen GH2 there cools the feed pump 9, which is inoperative during the gas removal and is to be kept cold and, behind the cold valve 19, downstream of the feed pump 9 is fed to the main removal pipe 22. It is further equalized with respect to its temperature in the second heat exchanger 10 and is guided by way of the pressure accumulator reservoir 12 and the shut-off valve 13 in the secondary system capsule 11 to the drive assembly inlet 14.

The filling of the cryotank 40 with cryogenically stored hydrogen is carried out by way of a fueling coupling 24 at the accessory container 6. Before a filling operation, by way of the cold feed pump 9, the complete filling train, including the diffuser 18, the filling pipe 17 the charging pipe 23 and the fueling coupling 24 are "operated cold" by circular conveying, in order to thereby accelerate the subsequent filling operation and to reduce return gas losses. For this purpose, the cold valves 8 and 25 are opened and the operation of the feed pump 9 is started. As a result, hydrogen is conveyed from the liquid phase LH2 by way of the first pipe 43 from the cryotank 1 by way of the central coupling 5 and the cold valve 8, by way of the feed pump 9 and the connection pipe 45 between the return gas pipe 26 and the fueling-coupling-side filling pipe 27, then by way of the cold valve 25 and the filling back 17, back into the inner reservoir 1.

A similar cold operation process can be used for operating the feed pipe 9 itself cold, as required. As in the case of the cold operation of the fueling train, the cold valve 8 is opened for this purpose and the operation of the feed pump 9 is started. However, instead of the cold valve 25, the cold valve 19 is opened and the gas flowing out of the feed pump 9 is guided by way of the first heat exchanger 21 and the second pipe 20 back into the inner reservoir 1.

The filling operation itself, by way of the fueling coupling 24 and the charging pipe 23, is initiated by coupling a filling-station-side coupling to the filling coupling 24 on the accessory container 6, whereby the return gas pipe 26 and the fueling-coupling-side filling pipe 27 are separated from one another in that the connection pipe 45 is interrupted. For opening the cold valve 25 for the filling and the cold valve 19 for the return gas, cryogenically stored hydrogen in a liquid state LH2 is distributed from the filling station through the fueling-coupling-side filling pipe 27 by way of the cold valve 25, the filling pipe 17, the central coupling 5 and the diffuser 18 in the inner reservoir 1. Simultaneously, by way of the second pipe 20 for the gas removal, the heat sink 3, the central coupling 5, the first heat exchanger 21, the cold valve 19 and the return gas pipe 26, return gas for the pressure reduction in the inner reservoir 1 is returned to the filling station. By way of the return gas flowing through the first heat exchanger 21, the feed pump 9 is cooled. This is used for a rapid availability of the full delivery capacity after the termination of the filling operation at the start of the operation of the hydrogen supply system for supplying the internal-combustion engine in the full-load operation.

During longer operating pauses of the hydrogen supply system, the pressure in the inner reservoir 1 rises by the continuous entering of heat from the environment by way of the outer reservoir 4, the insulation, the cooling shield 2 and the inner reservoir 1 into the liquid hydrogen LH2 stored there which converts the heat to evaporation. When the boil-off pressure is reached, a pressure relief valve 28 will open and gaseous hydrogen GH2 will be removed by way of a second pipe 20 for the gas removal, the heat sink 3, the central coupling 5 and the first heat exchanger 21 into a boil-off pipe 32. In this case, the removed hydrogen cools, in addition to the heat sink 3 with the cooling shield 2, also the feed pump 9 by way of the first heat exchanger 21. This is used for a rapid availability of the full delivery capacity after an operating pause when the operation of the hydrogen supply system is started for supplying the internal-combustion engine in the full-load operation.

In the case of a sudden entering of heat into the inner reservoir as a result of damage to the insulation or other defects, the pressure in the inner reservoir 1 will rise because of the increasing evaporation of the liquid hydrogen LH2. Since the removal of a sufficient amount of hydrogen through the boil-off pipe 32 would not be possible in such a case, the excess pressure safety valves 29 and 30 will open when the respective pressure level for the respective safety valve 29, 30 has been reached. In this case, the first responding safety valve 29 is coupled to the second pipe 20—the gas removal pipe—, and safety valve 30 is coupled to the first pipe 43 of the liquid removal device. Thus, it is ensured that, also in the event of an overhead position, with liquid hydrogen LH2 in the area of the opening of the second pipe 20—the gas removal pipe—, sufficient gaseous hydrogen GH2 can be removed by way of the safety valve 30 from the gaseous phase then present in the area of the liquid removal device.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for cryogenic storage and delivery of fuel supplied to a consuming device, the system comprising:

a cryotank comprising at least an outer reservoir, an inner reservoir for receiving a cryogenic medium, which inner reservoir is held in a heat-insulated manner in the outer reservoir, and a coolable cooling shield between the inner reservoir and the outer reservoir of the cryotank;

a heat sink which, as a thermal-energy storage device, is in heat-transmitting direct contact with the cooling shield; and a filling and removal device having at least one pipe penetrating the outer reservoir and leading into the inner reservoir, at least for the filling with or for the removal of cryogenic medium, the heat sink being in heat-transmitting contact with the at least one pipe for the cryogenic medium so as to reduce entry of heat from the environment into the inner reservoir while emitting heat;

wherein the inner reservoir has a recess in which at least the heat sink and the at least one pipe for the cryogenic medium are housed, such that the heat sink and the at least one pipe for the cryogenic medium are situated essentially entirely within a circumferential contour of the inner reservoir;

wherein the recess extends between two edges of the inner reservoir;

wherein no portion of the heat sink extends beyond the cooling shield from within the recess of the inner reservoir; and wherein for evacuating and filling the cryotank, at least three pipes are provided, which extend from the inner reservoir through the recess in the inner reservoir out of the outer reservoir, the first pipe being provided for removal of cryogenic medium predominantly in a liquid state (LH2) from a lower area of the cryotank, the second pipe being provided for removal of cryogenic medium predominantly in a gaseous state (GH2) from an upper area of the cryotank, and the third pipe being provided for return of the medium as hot gas into the upper area of the cryotank.

2. The system according to claim 1, wherein the heat sink is in heat-transmitting contact exclusively with the second pipe.

3. The system according to claim 1, wherein the heat sink has one or more continuous cavities to whose inlet and outlet the second pipe is sealingly connected.

4. The system according to claim 1, wherein the recess in the inner reservoir is a blending of the inner reservoir with a cylinder.

5. The system according to claim 4, wherein all pipes leading into the inner reservoir extend through its blending surface with the recess.

6. The system according to claim 1, wherein at one end, the heat sink projects beyond the circumferential contour of the inner reservoir to an extent that such a heat-transmitting connection with the cooling shield is formed.

7. The system according to claim 1, wherein at one end, the heat sink is connected in a heat-transmitting manner by at least one of screws and rivets with the cooling shield.

8. The system according to claim 1, further comprising another cooling shield that surrounds pipes situated within the recess and that is connected with the heat sink.

9. The system according to claim 1, wherein the at least three pipes extend from the inner reservoir through the recess in the inner reservoir out of the outer reservoir into an accessory container.

10. The system according to claim 9, wherein the accessory container, which is at least one of vacuum-insulated and evacuated, contains cold accessories for filling and evacuating the cryotank.

11. The system according to claim 9, wherein a container wall of the accessory container on an interior side is equipped with a heat insulation layer.

12. The system according to claim 9, wherein the accessory container is connected by way of at least one separable coupling device with the cryotank, the coupling device establishing tight connections between the pipes extending out of the cryotank and out of the accessory container.

13. The system according to claim 12, wherein the coupling device comprises a cryotank-side coupling part and an instrument-container-side coupling part, the cryotank-side coupling part being mounted on the outer reservoir.

14. The system according to claim 13, wherein the accessory container has at least one other connection point for at least one of filling the cryotank and supplying the consuming device, which other connection point, by way of at least one additional releasable coupling device having at least one connection part, establishes tight connections between pipes leading out of the accessory container and the connection part.

15. The system according to claim 9, further comprising a delivery device at least for removal of the liquid cryogenic medium from the cryotank, the delivery device being housed in the accessory container.

16. The system according to claim 15, wherein the delivery device is cooled by an additional heat exchanger.

17. The system according to claim 15, wherein the delivery device is a feed pump which has a low heat capacity.

18. The system according to claim 14, wherein the at least one connection part is a heat exchanger connected between the accessory container and the consuming device.

19. The system according to claim 18, further comprising a pressure reservoir for the gaseous cryogenic medium (GH2), which is connected in the consuming device direction behind the heat exchanger between the accessory container and the consuming device such that the consuming device as well as the cryotank are supplyable with pressurized gaseous cryogenic medium (GH2) from the pressure reservoir.

20. The system according to claim 16, wherein the second pipe is connected to the additional heat exchanger in order to cool the delivery device.

21. The system according to claim 16, wherein the first and the second pipe are joined in the consuming device direction behind the delivery device or behind the additional heat exchanger.

22. The system according to claim 16, wherein the first pipe and/or the second pipe or a junction of the first and the second pipe, in the consuming device direction behind the delivery device or behind the additional heat exchanger, are in a heat transmitting contact with the heat exchanger.

23. The system according to claim 1, wherein the third pipe for filling the cryotank is connected by way of a filling pipe with a fueling coupling.

24. The system according to claim 23, wherein a connection pipe is arranged between the filling pipe and a return gas pipe, said connection pipe connecting the filling pipe with the return gas pipe when the fueling coupling is not used for fueling.

25. The system according to claim 1, wherein the third pipe is equipped with a diffuser on one end in the cryotank.

26. The system according to claim 16, wherein in the consuming device direction behind the additional heat exchanger and in front of a junction with the first pipe, the second pipe has a branch-off pipe into a fueling coupling which, during a fueling, as a return gas pipe, leads gaseous cryogenic medium (GH2) displaced from the cryotank as a result of its filling to the fueling coupling.

27. The system according to claim 16, wherein in the direction of the consuming device behind the additional heat exchanger, a branch-off pipe to a pressure relief valve is connected to the second pipe, which pressure relief valve opens when a boil-off limit pressure has been reached, for blowing the gaseous medium (GH2) off out of the cryotank.

28. The system according to claim 27, wherein a branch-off pipe to a first excess pressure safety valve is connected to the second pipe in the consuming device direction in front of the additional heat exchanger, which excess pressure safety valve opens when a limit pressure above the boil-off pressure has been reached, for blowing off gaseous medium (GH2) out of the cryotank.

29. The system according to claim 28, wherein a branch-off pipe to a second excess pressure safety valve is connected to the first pipe in the consuming device direction in front of the delivery device, which excess pressure safety valve opens when a limit pressure above the boil-off pressure has been reached, for blowing off cryogenic medium (GH2, LH2) out of the cryotank.

30. The system according to claim 1, wherein the first pipe is linked to a change-over device which causes a removal of liquid hydrogen (LH2) until the cryotank is largely evacuated.

31. The system according to claim 15, wherein the accessory container is placed such that the delivery device is below or at the same level as pipe openings for the liquid removal in the lower area of the cryotank.

32. The system according to claim 1, wherein the consuming device is an engine for driving a motor vehicle.

33. The system according to claim 1, wherein the recess is situated essentially entirely within the circumferential contour of the inner reservoir.

* * * * *